United States Patent [19]

Finke

[11] Patent Number: 4,787,855

[45] Date of Patent: Nov. 29, 1988

[54] MULTIPLE BUSHING CONNECTOR APPARATUS

[75] Inventor: Ronald J. Finke, Houston, Tex.

[73] Assignee: Houston Industries Incorporated, Houston, Tex.

[21] Appl. No.: 58,578

[22] Filed: Jun. 5, 1987

[51] Int. Cl.[4] ..... H01R 4/66

[52] U.S. Cl. ..... 439/92; 29/857; 439/480; 439/921

[58] Field of Search ..... 174/586, 145; 29/857; 439/92, 100, 106, 480, 510–512, 518, 921, 923

[56] References Cited

U.S. PATENT DOCUMENTS 3,594,685 7/1971 Cunningham ..... 439/480

3,711,818 1/1973 Swehla ..... 439/480 X

*Primary Examiner*—Eugene F. Desmond

*Attorney, Agent, or Firm*—Pravel, Gambrell, Hewitt, Kimball & Krieger

[57] ABSTRACT

An apparatus is provided for grounding power distribution cable so that maintenance can be perfomed on power distribution equipment or the cable. The apparatus has multiple wells, at least two of which are adapted to receive any of several types of conductor bushing inserts to match the cable elbows, while a third receives a load break bushing which is adapted to receive a grounding elbow.

16 Claims, 3 Drawing Sheets

MULTIPLE BUSHING CONNECTOR APPARATUS

BACKGROUND OF THE INVENTION

1. FIELD OF THE INVENTION

The present invention relates to electrical power distribution safety equipment.

2. DESCRIPTION OF PRIOR ART

In the electrical power distribution industry, it is necessary to ground high voltage cables before performing maintenance on, or otherwise servicing, the cables. Otherwise, dangerous arcs can result if the cable being serviced is live or carrying current. This is a particular problem in underground residential distribution, or U.R.D., systems where the transformers are often located on a pad on the ground. The service crew members are also standing on the ground, causing a potential safety hazard unless precautions are taken.

Another problem is that there are numerous types of power distribution transformers, often having their power connection sockets spaced at different distances and mounted at different locations from each other on the transformer housing. This prevented any standard grounding equipment or procedure, and led to certain custom design or "ad hoc" grounding equipment designed for use on particular transformers. However, service crews often could not tell what type of grounding equipment was needed until their arrival at the job site.

SUMMARY OF THE INVENTION

Briefly, the present invention provides a new and improved apparatus for grounding power distribution cable at the connection of connector elbows of the cable to power distribution equipment. The apparatus includes at least three bushing wells for receiving conductor bushing inserts. The bushing wells have electrical conductors mounted in them which make electrical connection with a conductor bushing when it is inserted into the well. The electrical conductors are electrically connected in common by a conductive bus. The conductive bus and the bushing wells are mounted and contained in an insulative member, which also has structure on it for mounting the insulative member to the power distribution equipment.

At least one of the conductor bushing inserts used with the apparatus is a load-breaking bushing insert. After the bushing inserts are inserted into the bushing wells, the apparatus is mounted to the power distribution equipment at a location near the connection of the connector elbows of the cable. Prior to this, a grounding end of a grounding elbow is connected to an electrical ground of the power distribution equipment. The connector elbows of the cable are then removed from connection with the power distribution equipment and attached to a conductor bushing insert, one elbow at a time. The grounding elbow is then attached to load-breaking bushing, grounding the cables so that they may have maintenance or repair performed on them.

DESCRIPTION OF PREFERRED EMBODIMENT

Figure 1:
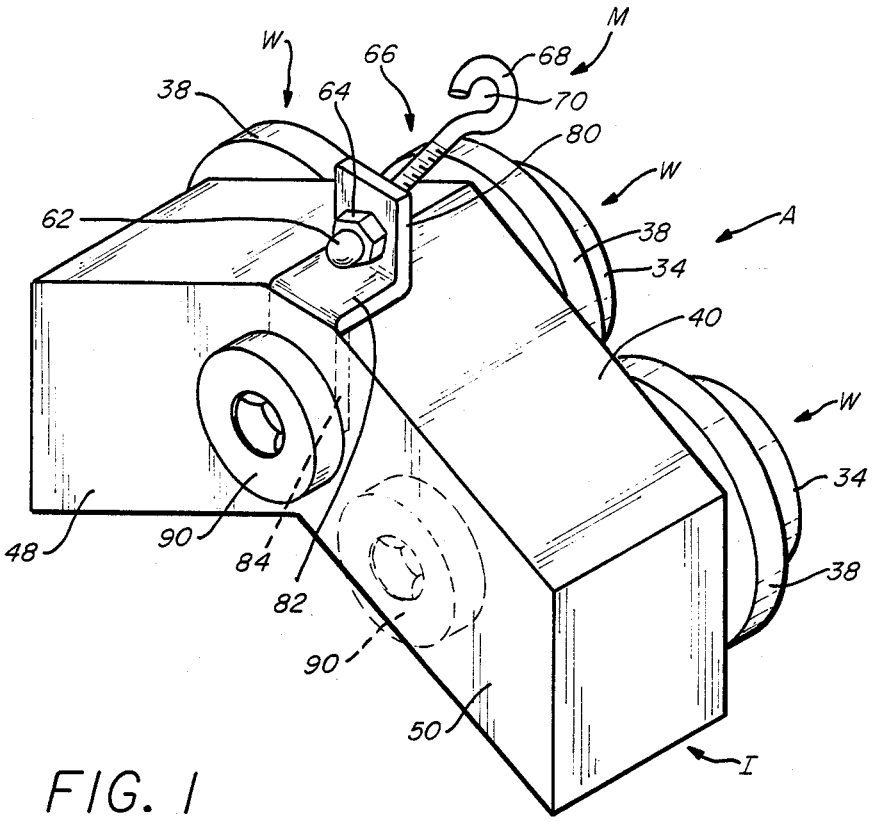
FIG. 1 is an isometric view of an apparatus according to the present invention.

In the drawings, the letter A designates generally an apparatus according to the present invention for grounding one or more power distribution cables P at the connection of electrical connector elbows L of the cables P to electrical power distribution equipment E. In the embodiment illustrated, the electrical power distribution equipment E is an underground residential distribution transformer (URD) mounted on a support pad 10, typically concrete, on an earthen surface 12.

Figure 5:
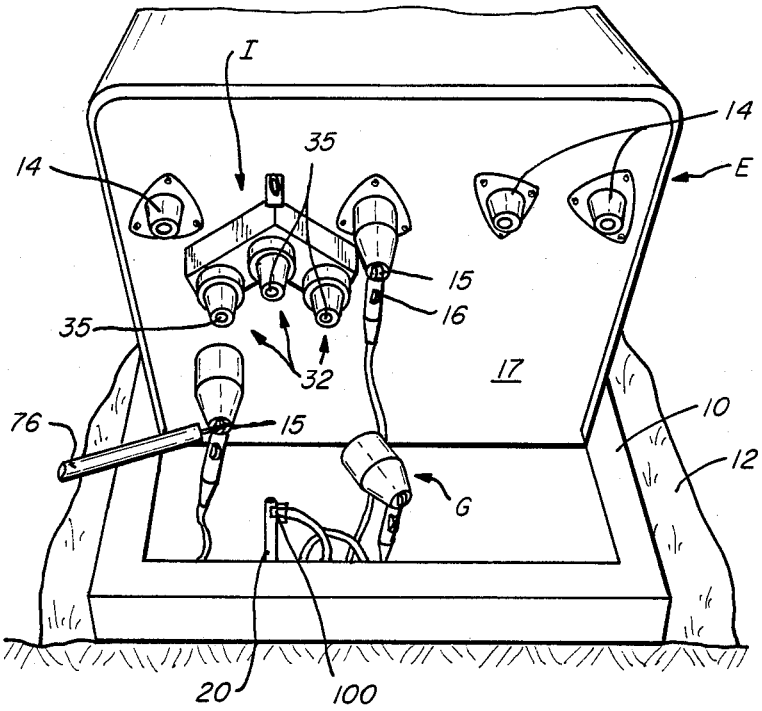
Figure 6:
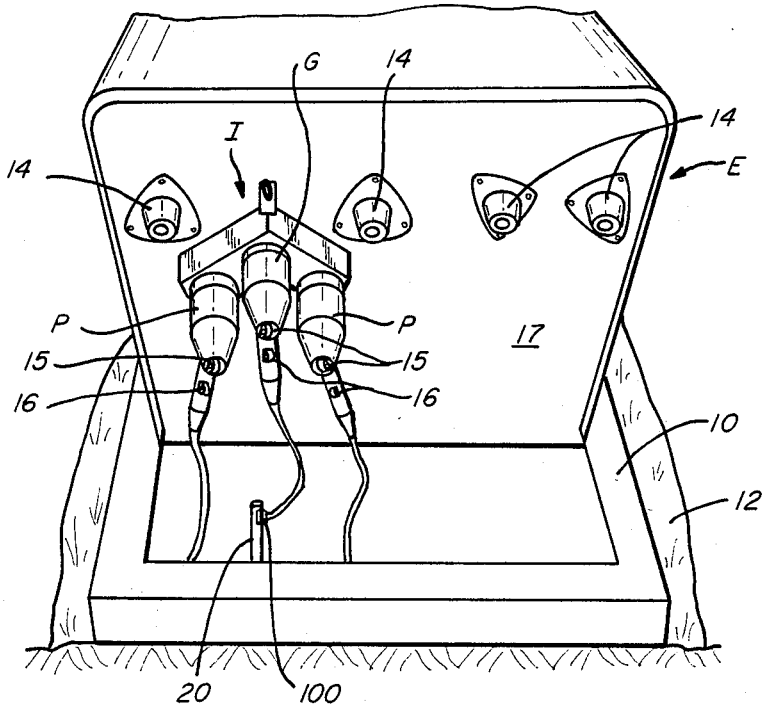

As is conventional, the power distribution cables P extend upwardly from beneath the earth's surface 12 and have the elbow connectors L mounted at upper ends thereof for connection to bushing inserts 14 (FIGS. 1, 5 & 6) extending outwardly from a front wall 16 of the distribution equipment E. The elbow connectors L have, as is conventional, coupling brackets 16 and removal eyelets 17 formed thereon for receipt of insulative manipulating instruments. Also mounted on the front wall 16 is a generally U-shaped support bracket 18, known in the art as a hanging stand. As is also typical, an electrical grounding stake 20 is located on the pad 10 near the connection between the elbows L and the bushing inserts 14, for reasons to be set forth.

Figure 2:
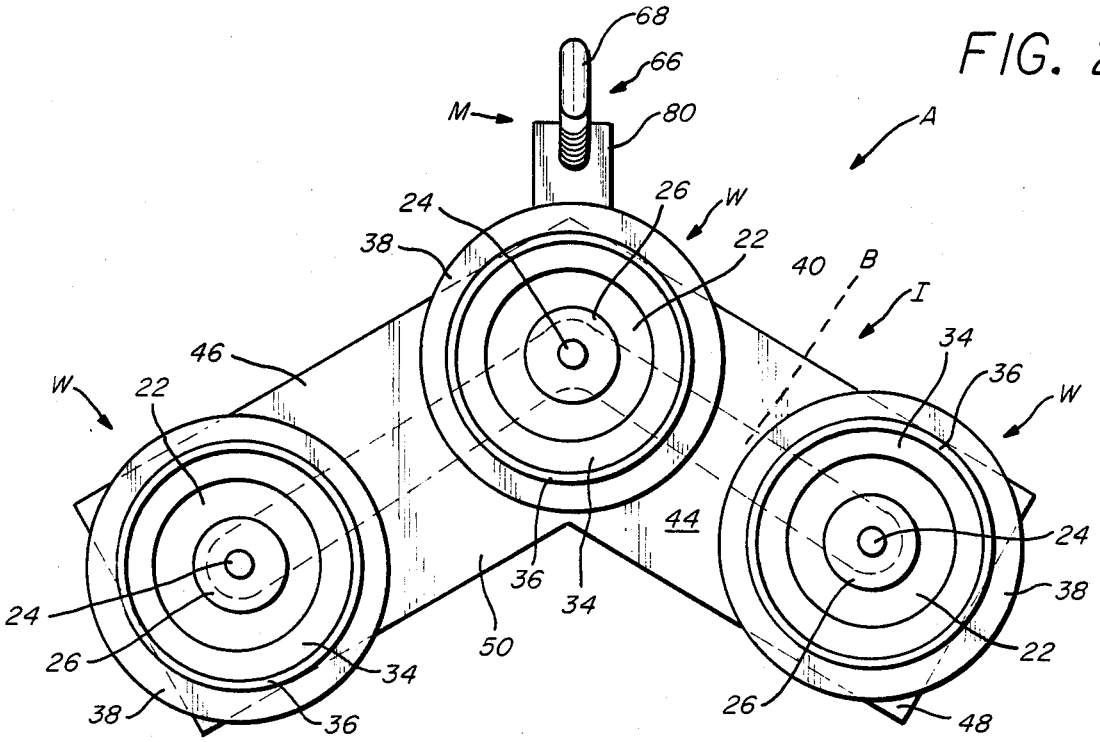
FIG. 2 is an elevation view of the apparatus of FIG. 1.
Figure 3:
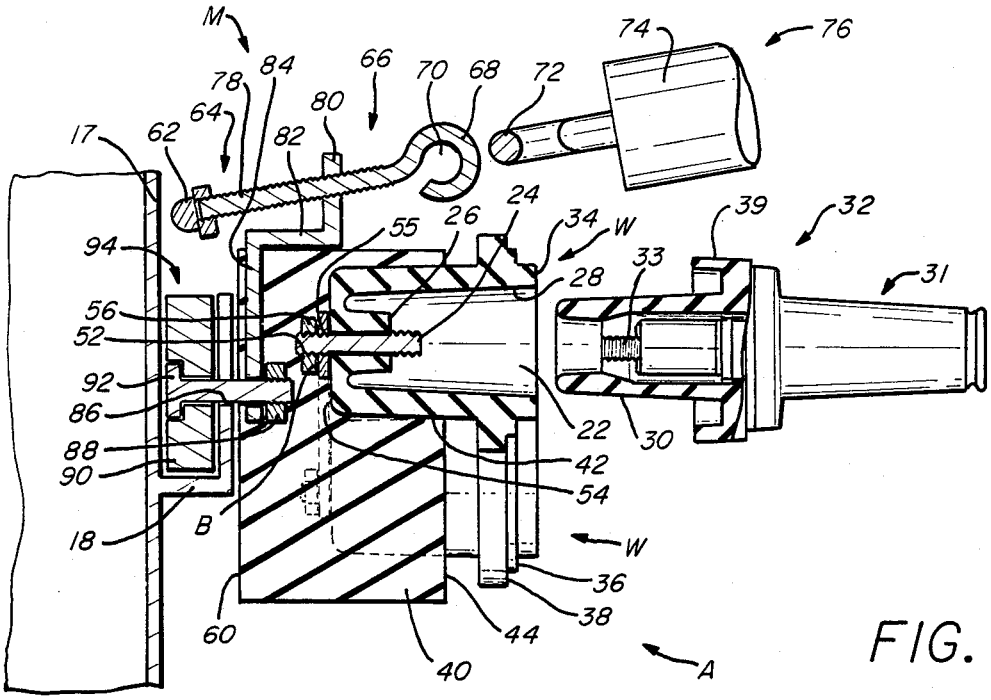
FIG. 3 i a cross-sectional view of the apparatus of FIG. 1.

In the apparatus A at least three cup-shaped, insulative bushing wells W are provided (FIGS. 1, 2 and 3). Each of the bushing wells W has a central socket 22 (FIG. 2) into which an electrical conductor 24 surrounded by an insulative mounting shoulder 26 extends. The central socket 22 has a side wall 28 tapered to conform to an outer surface 30 of an electrical bushing insert 32. The electrical conductors 24 are threaded along their extent into the central socket 22 so that bushing inserts 32 may be fixedly interconnected at threaded sockets 33 to the bushing wells W. The bushing inserts 32 have a tapered nipple 31 at an outer end which, as is conventional, has a central socket 35 (FIG. 5) for receiving a centrally located conductive electrical probe of the electrical elbows L. The bushing inserts 32 transfer electrical current from the elbow L to the power distribution equipment E in the conventional manner.

The bushing wells W have outer collar surfaces 34, 36 and 38 to sealingly fit with and engage corresponding surfaces of a shoulder 39 of the bushing insert 32.

Since the power distribution equipment E is located on the ground surface 12, it is necessary for service crew members to stand on the ground when servicing the equipment. Unless it can be safely determined that the power cables P are electrically grounded before they are serviced, the service crew members are under potential safety hazards, risking harm by electrical shock.

Each of the three bushing wells W is mounted in a molded insulative block I, formed from a suitable electrically insulative elastomer material 40. The bushing wells W are encapsulated along a portion of their outer surfaces 42 and extend outwardly from the front face 44 of the insulating block I. The insulating block I is generally of an inverted V-shape, having two outwardly extending arms 46 and 48 spreading from a central portion 50. A central one of the bushing wells W is mounted in a central portion 50 of the insulating block I, with each of the other two bushing wells W being mounted in one of the arms 46 and 48.

The electrical conductor 24 in each of the bushing wells W extends rearwardly outward at a threaded rear portion 52 beyond a rear wall 54 of the central socket 22. The threaded rear portion 52 of each electrical conductor 24 extends through an opening 55 of an electrically conductive bus bar B mounted within the molded insulative block I. The bus bar B is formed from a suitable electrically conductive material, such as copper, and is of a size and thickness greater than the conductors in the power cable P so as to be able to carry the high electrical current load in the event that the power distribution cable P to be grounded is conducting electricity. The arms 48 and 50 of the bus bar B are, for example, on the order of four inches long, one inch wide, and three-eighths inch thick.

A threaded nut or washer 56 is mounted on the threaded rear portion 52 of the electrical conductor 24 to fixedly connect each of the conductors 24 to the electrical bus bar B, insuring that electrical conductors in each of the bushing wells W are electrically connected in common by the bus bar B.

A mounting mechanism M is formed within an upper rear portion 58 of molded insulating block I adjacent a rear surface 60 opposite the front face 44. The mounting mechanism M includes a contact probe 62 formed of a suitable electrically insulative material mounted at an end 64 of threaded eyelet 66. The eyelet 66 has a head member 68 with a central opening 70 which is adapted to receive a hook 72 mounted at a head 74 of an insulative manipulator rod 76, known in the art as a barrel stick. A threaded central portion 78 of the eyelet 66 extends through a corresponding socket formed in an upwardly extending tab or lug member 80. When the hook 72 is inserted in the socket 70 of the eyelet 60, the eyelet 60 may be rotated, causing the contract probe 62 to advance or retract from the front wall 16 of the electrical distribution equipment E, depending upon the direction of rotation of the barrel stick 76.

The lug member 80 extends upwardly from a connector member 82 along an upper surface 84 of the insulative block I. At an opposite end of the connector member 82 from the lug 80 is a downwardly extending arm 84 which is encapsulated in the molded insulative block I behind the rear surface 60 thereof. A connector screw 86 is mounted to the arm 84 at a lower end thereof by a threaded nut or screw 88 within the molded insulative block I. A connector disk member 90 is mounted at an outer end 92 of the screw 86. The connector disk 90 is adapted to fit within a space 94 within the U-shaped support bracket 18, mounting the apparatus A to the electrical power distribution equipment E. It should be noted that the mounting mechanism M need not be centrally located in all instances. For example, it could be moved onto one of arms 48 or 50, so that disk member 90 would be located as shown in phantom in FIG. 1.

Figure 4:
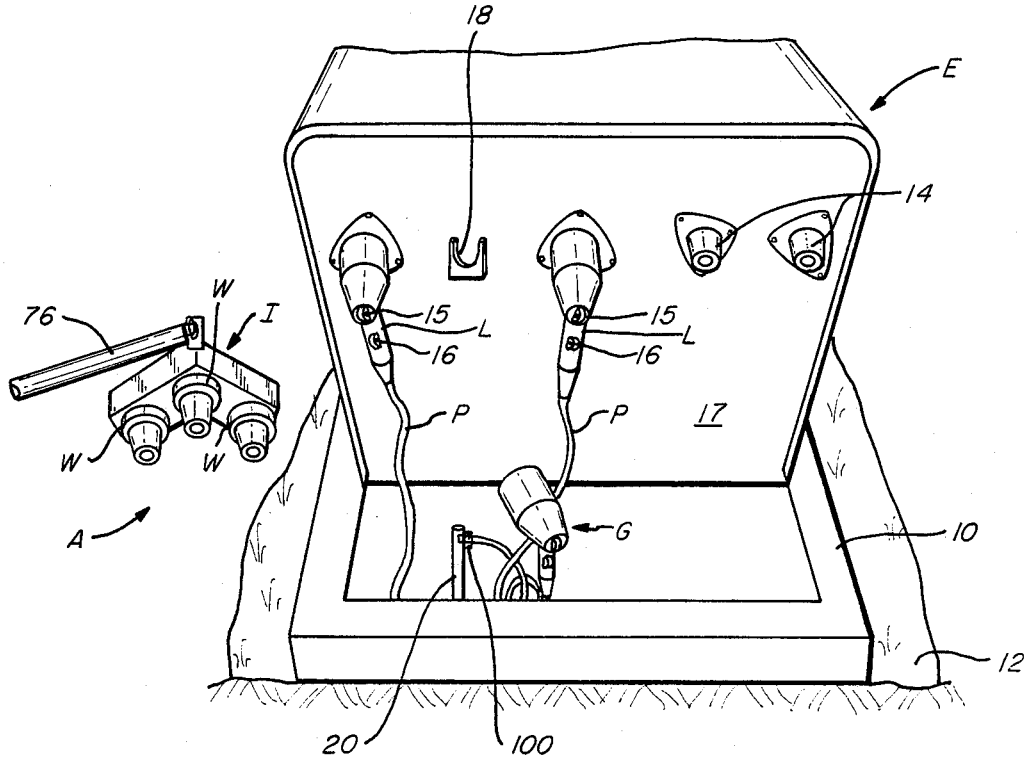
FIGS. 4, 5, and 6 are isometric views of the apparatus of FIG. 1 in use.

In the operation of the present invention, the servicing crew on arriving at the power distribution E inspects the bushing inserts on the equipment E by opening the equipment E. It is to be noted that the apparatus A can be used even if the bushing inserts on the equipment E are of the non-load break type, permitting grounding of them in any event, as will be set forth. After the proper type of bushing inserts have been determined, corresponding bushing inserts are then inserted into each of the bushing wells W of the apparatus A. Two bushing inserts are inserted corresponding to those on the power distribution equipment E in the bushing wells W best located to enable electrical connection of the elbows L to the apparatus A. For example, if the bushing inserts on power distribution equipment E are located close to each other, two adjacent bushing wells W would be used to receive bushing inserts. Conversely, if the equipment bushing inserts were relatively spaced from each other (FIG. 4), the bushing wells on arms 48 and 50 are used. In either case, in the third or remaining one of the bushing wells W, a load breaking bushing insert is placed. A suitable lubricant, such as silicone grease is then applied to the outer surfaces of all three bushing inserts and an insulated cap is preferably placed on each of the bushing inserts.

A clamp end 100 of a conventional electrical ground elbow G is then attached to the electrical grounding stake 20 and the ground elbow G placed at a convenient location on the support pad 10. The apparatus A is then connected at the eyelet 66 to the barrel stick 76 and the apparatus is moved until the connector disk fits within the support bracket 18 (FIG. 3). The eyelet 66 is then rotated until the contact probe 62 firmly engages the front wall 16 of the equipment E, locking the apparatus A firmly in place on the front face 16 of the equipment E. The service crew member then moves the hook 72 of the barrel stick 76 from the eyelet 66 into a removal eyelet 16 of a first one of the connector elbows L. The service crew member then pulls the connector elbow L out of electrical contact with the bushing insert of the equipment E, breaking any electrical connection therebetween. The removed elbow connector L is then moved into position and inserted onto a first of the bushing inserts 32 in a bushing well W of the apparatus A and moved firmly into mechanical contact by use of force applied through coupling bracket 15 by the barrel stick 76, insuring electrical connection between the probe in the elbow L and the bushing insert 32. This procedure is then repeated for the second of the electrical elbow connectors L, mounting same onto a second bushing insert of the type matching the connector elbows L. At this point, the insulated cap on the load breaking bushing insert is then removed using the barrel stick and the grounding elbow G is then installed onto the load-breaking insert 32. In the event that the cables P are carrying power, the bus bar B due to its size is capable of carrying current levels present until the load breaking bushing insert has accomplished its function. At this point, both of the connector elbows L and the grounding elbow G are electrically connected in common through the bus bar B to electrical ground through the grounding stake 20, insuring that each of the power distribution cables P is grounded so that service work can begin on them.

The apparatus A of the present invention also allows the use of any bushing insert that meets American National Standards Institute (A.N.S.I.) standards. The apparatus A can also be used to provide a power feed through, if desired.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

I claim:

1. An apparatus for grounding power distribution cable at the connection of connector elbows of the cable to power distribution equipment, comprising:

(a) at least three bushing wells for receiving conductor bushing inserts, one of which inserts is a load-breaking insert adapted to receive a connector elbow of a grounding cable, the other inserts being adapted to receive the connector elbows of the cable;

(b) at least three electrical conductor means, each mounted in a separate one of said bushing wells for making electrical connection with a bushing inert when inserted therein;

(c) bus means joining said electrical conductor means electrically in common;

(d) insulative means for containing said bushing wells and said bus means therein; and (e) means for mounting said insulative means to the power distribution equipment.

2. The apparatus of claim 1, wherein said bus means comprises:

a conductive metal bar.

3. The apparatus of claim 1, wherein:

said bus means is mounted at a rear end of said bushing wells in electrical contact with said electrical conductor means.

4. The apparatus of claim 1, wherein said insulative means comprises:

an insulative block.

5. The apparatus of claim 4, wherein:

said insulative block is formed from an insulative elastomer.

6. The apparatus of claim 4, wherein:

said bushing wells are mounted on a first face of said insulative block.

7. The apparatus of claim 6, wherein:

said means for mounting is mounted on a face of said insulative block opposite from said first face.

8. The apparatus of claim 4, wherein:

said bus means is embedded within said insulative block.

9. The apparatus of claim 4, wherein:

said bus means is mounted within said insulative block at a rear end of said bushing wells in electrical contact with said electrical conductor means.

10. The apparatus of claim 1, wherein:

said means for mounting is located on said insulative means at a position to allow two of said bushing wells to be located near the connector elbows of the cable when said insulative means is mounted on the power distribution equipment.

11. The apparatus of claim 1, wherein:

(a) said insulative means has a central portion on one face thereof; and (b) one of said bushing wells is mounted in said central portion.

12. The apparatus of claim 11, wherein:

(a) said insulative means has outwardly extending arms from said central portion; and (b) one of said bushing wells is mounted in each of said outwardly extending arms.

13. The apparatus of claim 12, wherein:

said outwardly extending arms extend outwardly at intersecting angles from said central portion.

14. An apparatus for grounding power distribution cable at the connection of connector elbows of the cable to power distribution equipment, comprising:

(a) at least three bushing wells for receiving conductor bushing inserts;

(b) load breaking inserts mounted in each of said bushing wells;

(c) one of said load breaking inserts comprising a load-breaking insert for receiving a connector elbow of a grounding cable;

(d) the others of said load-breaking inserts comprising inserts for receiving connector elbows of the power distribution cable;

(e) bus means joining said electrical conductor means electrically in common;

(f) insulative means for containing said bushing wells and said bus means therein; and (g) means for mounting said insulative means to the power distribution equipment.

15. A method of grounding power distribution cable at the connection of connector elbows of the cable to power distribution equipment comprising the steps of:

(a) attaching a ground end of a grounding end of a grounding elbow to an electrical ground of the power distribution equipment;

(b) mounting an insulative block having at least three conductor bushing inserts therein, at least one of which is a load-breaking insert, and all of which are commonly electrically connected, to the power distribution equipment;

(c) removing a first one of the connector elbows from the power distribution equipment;

(d) attaching the first of the connector elbows at one of the conductor bushing inserts;

(e) removing a second one of the connector elbows from the power distribution equipment;

(f) attaching the second of the connector elbows to another of the conductor bushings;

(g) attaching the elbow portion of the grounding elbow to a load-breaking bushing insert on the insulative block.

16. The method of claim 15, further including the verifying that a load-breaking bushing insert remains available during said step of attaching the second of the connector elbows.

* * * * *